United States Patent [19]

Hytti

[11] Patent Number: 4,485,715

[45] Date of Patent: Dec. 4, 1984

[54] METHOD FOR MANUFACTURING INSULATING TROUGHS FOR PIPES, AND AN APPARATUS FOR CARRYING OUT THE METHOD

[75] Inventor: Teuvo T. Hytti, Lappeenranta, Finland

[73] Assignee: OY Partek AB, Parainen, Finland

[21] Appl. No.: 234,685

[22] Filed: Feb. 17, 1981

[30] Foreign Application Priority Data

Feb. 19, 1980 [FI] Finland ..... 800489

[51] Int. Cl.[3] ..... B26B 7/00; B26D 3/06

[52] U.S. Cl. ..... 83/875; 30/272 R; 30/374; 30/380

[58] Field of Search ..... 83/875, 876, 871; 30/380, 371, 374, 272 R, 272 A

[56] References Cited

U.S. PATENT DOCUMENTS

| | | | |
|---|---|---|---|
| 2,958,355 | 11/1960 | Young | 30/272 R X |
| 3,312,131 | 4/1967 | Gilmore | 83/875 |
| 3,332,459 | 7/1967 | Gilmore | 83/875 X |
| 3,338,122 | 8/1967 | Lampe | 83/875 |
| 3,491,631 | 1/1970 | Skinner | 83/875 X |
| 4,140,036 | 2/1979 | Davis | 83/875 X |

*Primary Examiner*—Frank T. Yost

*Attorney, Agent, or Firm*—Bucknam and Archer

[57] ABSTRACT

The invention relates to a method for manufacturing insulating troughs for pipes, especially pipe bends. According to the method semicircular portions of a pair of concentric cutting blades having radii of curvature corresponding to the outer diameter of the insulating trough and the outer diameter of the pipe respectively, are applied with their cutting edges in a vertical plane against one edge of a board of insulating material, the blades are set in motion in their circumferential direction and advanced through the material of the board along a path corresponding to the desired shape of the insulating trough. An apparatus for carrying out the method is also disclosed.

4 Claims, 2 Drawing Figures

METHOD FOR MANUFACTURING INSULATING TROUGHS FOR PIPES, AND AN APPARATUS FOR CARRYING OUT THE METHOD

BACKGROUND OF THE INVENTION

1. Field of the Invention

The present invention relates to a method for manufacturing insulating troughs for pipes, especially pipe bends.

2. Description of the Prior Art

Pipe bends are usually insulated by first packing mineral wool by hand around the pipe bend and then tying it with band-like material, which is wound around the insulating material. Often the insulation is also enclosed in a plate casing. The work is time-consuming and therefore the costs are high. Another method is first to fit a plate casing around the pipe bend and then to fill the casing with cast or injected insulating material. This method is also cumbersome. As regards the installation, the use of profiled insulating troughs which have been pre-cast or pre-injected is considerably more advantageous than the methods mentioned above, since the troughs are simply placed opposite each other around the pipe bend and bound together by means of a band or glue. The manufacture of the insulating troughs is, however, immoderately expensive, since a wide range of insulating troughs for pipe bends of different dimensions must be kept in stock, and the thickness of the troughs varies.

SUMMARY OF THE INVENTION

The object of the present invention is to provide a simple and inexpensive method for manufacturing insulating troughs for pipes, especially pipe bends. According to the invention this problem is solved by applying semicircular portions of a pair of concentrical cutting blades, the radii of curvature of said blades corresponding to the desired outer diameter of the insulating trough and the desired outer diameter of the pipe respectively, with their cutting edges in the same vertical plane against one edge of a board of insulating material, setting said blades in motion in their circumferential direction, and cutting an insulating trough out of the material of said board by advancing either one of said pair of blades and said board along a path corresponding to the desired shape of said insulating trough.

The motion of said blades in their circumferential direction can be a reciprocating motion, a high-frequency oscillatory motion having a small amplitude or a rotating motion.

The invention also provides an apparatus for manufacturing an insulating trough for a pipe, especially a pipe bend, said apparatus comprising a frame, a pair of cutting blades mounted on said frame having essentially semicircular concentric portions thereof extending beyond a support member and having cutting edges lying in the same plane, the radii of curvature of said blades corresponding to the desired outer diameter of said insulating trough and the desired outer diameter of said pipe respectively, and means on said frame operatively connected to said blades for setting said blades in motion in their circumferential direction.

One embodiment of the apparatus comprises a frame, a planar foot member rigidly mounted on said frame, a support member mounted on said frame swingable about an axis extending in parallel with the plane of said foot member, said support member carrying a pair of cutting blades having essentially semicircular concentric portions thereof extending beyond said foot member and having cutting edges lying in a plane perpendicular to the plane of said foot member, actuating means on said frame operatively connected to said support member for setting it in a reciprocating motion about its axis, and drive on said frame operatively connected to said actuating means.

In a further embodiment of the invention the frame is slidably mounted on an elongated beam extending above and in parallel with a horizontal table and being mounted swingably about a vertical axis, means being provided for securing said frame to said beam in selected positions along the extension thereof.

Either the table or the beam or both may be adjustable in the vertical direction in order to regulate the distance of the beam from the table.

BRIEF DESCRIPTION OF THE DRAWING

In the accompanying.

DESCRIPTION OF THE PREFERRED EMBODIMENTS

Figure 2:
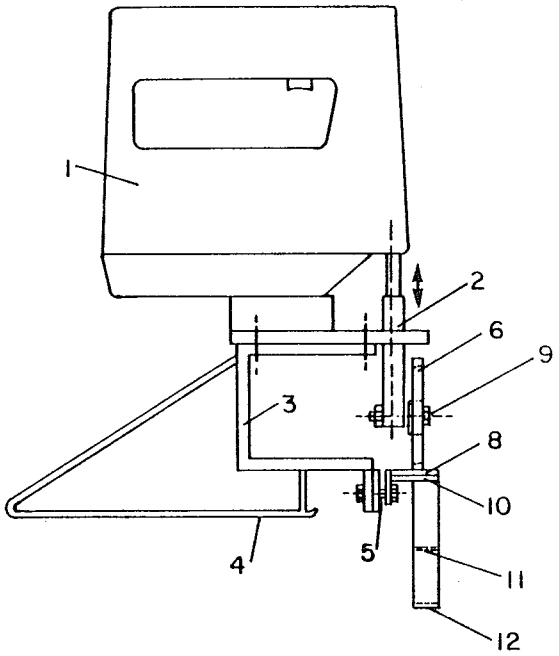
FIG. 2 depicts the apparatus as seen perpendicularly to the figure in FIG. 1.
Figure 1:
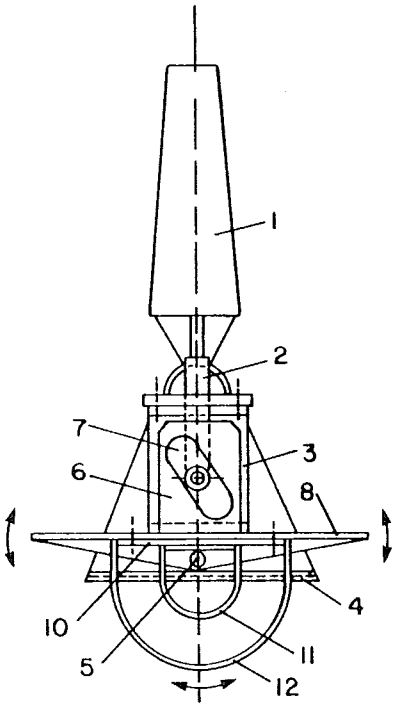
FIG. 1 depicts the apparatus as seen in the working direction of the blades.

In the drawing, 1 designates a driving motor provided with a handle and placed in a casing, the motor preferably being an electric motor which moves a vertically installed piston arm 2 reciprocatingly. Under the casing 1 of the motor there is fitted a frame 3 to which a foot plate 4 is attached. Also mounted on the frame 3 there is a vertical plate 6, attached with bearings to turn about a pin 5 and having a groove 7 which is inclined in relation to the vertical direction. The plate 6 supports a transversal arm 8. Working in conjunction with the groove 7 there is a pin 9 protruding from the piston arm 2, the pin being preferably rotating or provided with a rotating sleeve in order to reduce friction. The up-and-down movement of the piston arm 2 brings, under the combined effect of the pin 9 and the groove 7, the plate 6 into a reciprocating pendulum motion, the amplitude of which is determined by the inclination of the groove and the stroke length of the piston arm. For example, these are selected so that the pendulum motion will be approx. 10° on both sides of the vertical line.

To the transversal arm 8 there is detachably attached a support 10, to which two cutting blades 11 and 12 are attached rigidly. The cutting blades are of band steel with a thickness of, for example, approx. 1 mm and a width of approx. 10 mm. The blades 11 and 12 are bent to the form of an arc of a circle. The radius of the inner blade 11 corresponds primarily to the radius of the outer circumference of the pipe to be insulated with the insulating trough, whereas the radius of the outer blade 12 corresponds to the radius of the circumference of the insulating trough. The blades 11 and 12 can be sharpened to form a cutting edge only at one edge or at both edges. The latter case makes it possible to turn the blades when one cutting edge has dulled, a factor which lengthens the useful period of the blades between sharpenings. When only one edge of the blades is sharpened, they are placed with the cutting edges towards the frame 3 so that, when the apparatus is in operation, the foot plate 4 travels ahead of the blades in the working direction. The length of the blades 11 and 12 in their circumferential direction somewhat exceeds a semi-circle, and thus, when the transversal arm 8 is in the horizontal position, those parts of the blades which extend below the foot plate 4 form a semi-circle.

The described embodiment of the apparatus according to the invention can be used as a manually controlled cutting apparatus. In this case, the apparatus is set in such a manner that the foot plate 4 rests against the surface of a board of insulating material, the thickness of which corresponds to at least half the diameter of the desired insulating trough. The insulating material can be, for example, mineral wool or cell plastic. The cutting edges of the blades 11, 12 are placed against the side edge of the board or almost against it, and the driving motor is started in order to bring the blades into a reciprocating motion. In order to obtain the desired curved shape for the insulating trough, a template is used the curvature of which corresponds to the curvature of the pipe. The apparatus is moved forward along the template, the inner blade 11 cutting a groove for the pipe and the outer blade 12 cutting the outer circumference of the insulating trough.

For obtaining different pipe diameters and different thickness of insulating troughs, replaceable blade combinations installed in the supports are used, corresponding to each desired radius of curvature of the inner blade and the outer blade.

According to one preferred embodiment of the apparatus according to the invention, the driving mechanism, as well as the frame and the blades, are mounted on a beam which has been attached with bearings so that it can be swivelled in the horizontal direction, the beam not being shown in the drawing, in such a manner that the frame can be adjusted in the longitudinal direction of the arm, and preferably also swivelled. Thus, without having to use templates, different radii of curvature can be obtained for the insulating troughs, and, of course, straight insulating troughs can also be cut. The beam can be adjustable in the vertical direction or, and preferably, the table supporting the band of insulating material can be adjustable in the vertical direction so that the blades can be brought to the correct height in relation to the surface of the board. Thus a foot plate 4 is not necessary in this embodiment, nor is a handle for the motor casing necessary.

It should be obvious that the embodiment depicted in the drawing can be varied in several ways within the scope of the accompanying claims. Thus, in order to bring the blades into a reciprocating motion, the apparatus can be made so that the blades go through a high-frequency reciprocal motion which has a small amplitude and is thus comparable to an oscillatory motion. The cutting apparatus can in this case also be either manually controlled or installed in a swivelling and adjustable supporting member. Furthermore, the blades can be toothed instead of being smooth, although the latter embodiment produces less dust.

It is also possible to cause the blades to rotate instead of moving reciprocatingly. This can be achieved by forming the blade inside it, and possibly also outside it, is given the desired shape of an arc of a circle. In this case the blade's drive is at the support roller and from the opposite side by means of a rotatable driving roller resting against the blade. In this embodiment there is preferably used a supporting blade which settles against the board of insulating material and has grooves for the blade, and thus that part of the blade which travels below the supporting plate forms the desired arc for cutting a groove for the pipe and for cutting the outer periphery of the insulating trough. In this case also, the blades can be either toothed or smooth on the edge.

When the cutting apparatus is intended for cutting insulating troughs from boards of plastic material, the blades can be heated in order to facilitate cutting further.

If it is desired to cut grooves for pipes in boards of insulating material, for example, parallel grooves for two or more pipes, the apparatus according to the invention can be modified in a simple manner by eliminating the blade which determines the outer diameter of the insulating trough and by using only the blade corresponding to the outer diameter of the pipe. When using this modified apparatus, the manner of cutting the grooves can be similar to the manner of cutting when using an apparatus with two blades.

What is claimed is:

1. A method for cutting insulation material to form an insulating trough having an irregularly bent form in the longitudinal direction for receiving a correspondingly bent pipe, which method comprises oscillating a pair of generally concentric cutting band blades rotatibly about a common axis in a common cutting plane; and advancing said oscillating blades by hand along a path in accordance with said irregularly bent form of the insulating trough along the upper surface of the insulation material, which will form the upper surface of the trough, the larger radius blade cutting said insulation material along said path thereby forming the outer surface of said insulating trough, and the smaller radius blade cutting said insulation material along said path thereby forming the inner surface of said trough corresponding to the dimensions of said pipe.

2. A method according to claim 1 wherein said blades are oscillated at a high frequency and small amplitude.

3. A handtool for making an insulation trough having an irregularly bent form in the longitudinal direction, said trough being adapted to receive a pipe, which handtool comprises a frame; a planar foot member rigidly mounted on said frame; a support member mounted on said frame and turnable about an axis extending in the same direction as the plane of said foot member, said support member carrying a pair of cutting blades having essentially concentric semicircular portions thereof protruding from said foot member and having cutting edges lying in a plane perpendicular to the plane of said foot member; actuating means on said frame operatively connected to said support member for bringing said support member in a reciprocating motion about its axis, and drive means on said frame operatively connected to said actuating means to operate same.

4. A handtool for making an insulation trough according to claim 3 wherein said support member is connected to said frame; and said semicircular portions of the cutting blades protrude from a horizontal plane of said foot member; and the radii of curvature of said cutting blades corresponds to a selected outer radius of said insulation trough and a selected outer radius of said pipe respectively.

* * * * *